US005748153A

United States Patent [19]

McKinzie, III et al.

[11] Patent Number: 5,748,153

[45] Date of Patent: May 5, 1998

[54] FLARED CONDUCTOR-BACKED COPLANAR WAVEGUIDE TRAVELING WAVE ANTENNA

[75] Inventors: William Edward McKinzie, III, Culver City; Tracy Lynn Anderson, Whittier, both of Calif.

[73] Assignee: Northrop Grumman Corporation, Los Angeles, Calif.

[21] Appl. No.: 669,857

[22] Filed: Jun. 26, 1996

Related U.S. Application Data

[63] Continuation of Ser. No. 336,028, Nov. 8, 1994, abandoned.

[51] Int. Cl.[6] ..... H01Q 13/08

[52] U.S. Cl. ..... 343/767; 343/770

[58] Field of Search ..... 343/767, 770, 343/700 MS, 771

[56] References Cited

U.S. PATENT DOCUMENTS

| | | | |
|---|---|---|---|
| 3,518,691 | 6/1970 | Hallendorff | 343/863 |
| 4,001,834 | 1/1977 | Smith | 343/795 X |
| 4,853,704 | 8/1989 | Diaz et al. | 343/767 |
| 5,023,623 | 6/1991 | Kreinheder et al. | 343/767 X |
| 5,227,808 | 7/1993 | Davis | 343/763 X |
| 5,327,198 | 7/1994 | How et al. | 343/700 MS |

*Primary Examiner*—Donald T. Hajec
*Assistant Examiner*—Tho Phan
*Attorney, Agent, or Firm*—Terry J. Anderson; Karl J. Hoch, Jr.

[57] ABSTRACT

A conductor-backed coplanar waveguide traveling wave antenna including a dielectric substrate, a coplanar waveguide structure disposed on the substrate, a plate separated from the substrate for concentrating energy radiated by the antenna generally in a half-space adjacent the exterior of the coplanar waveguide structure, and a feed electrically coupled to the coplanar waveguide for transmitting electromagnetic energy to and from the antenna. Preferably, the plate includes a conductive surface facing the substrate. The aforementioned substrate and plate are separated by a structure which has electromagnetic wave absorbing properties. This antenna is flush-mountable because the separation between the plate and substrate can be made very small, and has broadband capabilities due to its traveling wave producing structure. In addition, the antenna produces significant gain patterns in the forward field of view in a plane parallel to the radiating surface of the coplanar waveguide, and E field polarization perpendicular to this plane of the radiating surface.

23 Claims, 10 Drawing Sheets

OUTER CURVE

| | |
|---|---|
| −2 | 0.082 |
| −1.8 | 0.084 |
| −1.6 | 0.087 |
| −1.4 | 0.09 |
| −1.2 | 0.094 |
| −1 | 0.098 |
| −0.8 | 0.104 |
| −0.6 | 0.111 |
| −0.4 | 0.12 |
| −0.2 | 0.131 |
| 0 | 0.144 |
| 0.2 | 0.16 |
| 0.4 | 0.179 |
| 0.6 | 0.203 |
| 0.8 | 0.232 |
| 1 | 0.268 |
| 1.2 | 0.311 |
| 1.4 | 0.364 |
| 1.6 | 0.428 |
| 1.8 | 0.507 |
| 2 | 0.604 |
| 2.2 | 0.721 |
| 2.4 | 0.865 |
| 2.6 | 1.041 |
| 2.8 | 1.255 |
| 3 | 1.517 |
| 3.2 | 1.837 |
| 3.4 | 2.228 |
| 3.6 | 2.705 |
| 3.8 | 3.288 |
| 4 | 4 |

FIG. 3A

INNER CURVE

| | |
|---|---|
| −2 | 0.051 |
| −1.8 | 0.052 |
| −1.6 | 0.052 |
| −1.4 | 0.052 |
| −1.2 | 0.053 |
| −1 | 0.054 |
| −0.8 | 0.054 |
| −0.6 | 0.055 |
| −0.4 | 0.057 |
| −0.2 | 0.058 |
| 0 | 0.06 |
| 0.2 | 0.062 |
| 0.4 | 0.065 |
| 0.6 | 0.068 |
| 0.8 | 0.072 |
| 1 | 0.077 |
| 1.2 | 0.083 |
| 1.4 | 0.09 |
| 1.6 | 0.098 |
| 1.8 | 0.109 |
| 2 | 0.122 |
| 2.2 | 0.138 |
| 2.4 | 0.158 |
| 2.6 | 0.182 |
| 2.8 | 0.211 |
| 3 | 0.247 |
| 3.2 | 0.29 |
| 3.4 | 0.343 |
| 3.6 | 0.408 |
| 3.8 | 0.488 |
| 4 | 0.585 |
| 4.2 | 0.703 |
| 4.4 | 0.847 |
| 4.6 | 1.024 |
| 4.8 | 1.24 |
| 5 | 1.503 |
| 5.2 | 1.825 |
| 5.4 | 2.218 |
| 5.6 | 2.698 |
| 5.8 | 3.284 |
| 6 | 4 |

FIG. 3B

| FREQUENCY (GHz) | ELEVATION ANGLE OF MAIN BEAM | HALF-POWER BEAMWIDTH | | PEAK GAIN (dBi) | ON-HORIZON GAIN (dBi) |
|---|---|---|---|---|---|
| | | ELEVATION | AZIMUTH | | |
| 1 | 40° | 84° (11–95°) | 55° | 1.8 | −2.7 |
| 1.5 | 32° | 45° (8–53°) | 52° | 3.9 | −1.8 |
| 2 | 28° | 35° (10–45°) | 41° | 7.5 | 1.9 |
| 2.5 | 25° | 30° (8–38°) | 47° | 6.4 | 0.6 |
| 3 | 23° | 28° (7–35°) | 38° | 6.4 | 1 |
| 4 | 18° | 23° (5–28°) | 62° | 7.1 | 2.1 |
| 5 | 15° | 19° (4–23°) | 50° | 7.4 | 2.4 |
| 6 | 13° | 19° (2–21°) | 60° | 7.6 | 3.4 |
| 7 | 12° | 19° (1–20°) | 54° | 9.5 | 6 |
| 8 | 10° | 17.5° (0–17.5°) | 47° | 8.4 | 5.4 |

FIG. 8

FLARED CONDUCTOR-BACKED COPLANAR WAVEGUIDE TRAVELING WAVE ANTENNA

This is a continuation, of application Ser. No. 08/336,028, filed Nov. 8, 1994, now abandoned.

BACKGROUND

1. Technical Field

This invention relates to antenna structures, and in particular to flush-mountable broadband antennas having significant gain patterns in the forward field of view in a plane parallel to the antenna's radiating surface.

2. Background Art

Many antenna applications call for an antenna which can be conformed to an external surface so as to not interfere with the desire characteristics of the surface. For example, such an antenna is advantageously used in conjunction with an aircraft wing or fuselage since it will not adversely affect the aerodynamics of the aircraft surface. Similarly, these flush-mountable antennas are useful, for example, in connection with all types of aircraft, missiles, unmanned air vehicles (UAVs), and automobiles.

Traditionally, cavity backed slot antennas have been used in these applications requiring a conformally mounted antenna. Typically, such antennas are composed of a metal surface backed by an energized resonant cavity and having a slot through which energy is radiated directionally. The resonant cavity which backs the radiating slot is mounted inside the aerodynamic surface. To accommodate this cavity there must be unused space available at the mounting site. But, in most applications, interior space is at a premium. Therefore, it is essential that the antenna be designed so as to minimize the physical size of the cavity to the extent feasible without duly sacrificing the performance characteristics of the antenna.

The prior art cavity-back slot antennas have in general achieved reasonably shallow cavity depths while accomplishing their objectives under the range of operating conditions for which they were designed. However, since these cavity-back slot antenna are resonance based structures, they generally exhibit a narrowband performance. Prior art cavity-backed slot antennas have VSWR bandwidths of at most 50%. They can be operated at frequencies up to about twice their fundamental resonant frequency. At higher frequencies their radiation pattern divides into multiple lobes and becomes unusable.

In addition, single-slotted cavity-backed slot antennas, when used alone, do not provide directive gain in a plane parallel with their radiating surface. Rather, at best, an omni-directional E-plane pattern is generated from these types of antennas. Thus, if such an antenna were mounted to a horizontal wing surface of an airplane a directive gain would not be realized along the forward field of view that includes the horizon. As will be described later, directive gain at the horizon is very desirable in $166\times_{25}$ avionic applications.

If one desires gain at the horizon, it may be enhanced by building log-periodic arrays of slots, but this has historically meant an individual cavity behind each slot along with a complicated modulated-impedance feedline structure. Also, cavity depth of these types of antennas is typically one-quarter of a free space wavelength at each slot's resonant frequency. This depth can be excessive for many applications.

Therefore, what is often needed is a flush-mountable antenna capable of providing significant gain in the forward field of view in a plane parallel to the antenna's radiating surface, over a broad frequency range.

SUMMARY

The present invention provides such a broadband flush-mountable antenna designed to satisfy the aforementioned needs. This antenna employs a finite length of conductor-backed coplanar waveguide (CBCPW). The CBCPW structure of the antenna allows for an extremely shallow depth to facilitate its mounting flush with an exterior surface, such as a horizontal wing surface of an aircraft. The depth of the antenna structure depends on the separation between the coplanar waveguide and its conductor backing. Essentially, this separation need only be sufficient to efficiently propagate the electromagnetic energy along the centerline of the antenna's radiating surface (i.e. the coplanar waveguide). The CBCPW structure is also responsible for the antenna's broadband capabilities. This structure creates a traveling wave antenna whose radiation pattern and impedance characteristics are substantially independent of frequency, especially over the microwave spectrum.

The coplanar waveguide portion of the antenna has a flared shape. This flared shape in combination with the CBCPW structure of the antenna creates a radiation pattern that has substantial gain in the forward field of view in a plane parallel to the radiating surface. This has great advantage for use in avionics. For instance, if the antenna is flush-mounted in a horizontal wing surface of an aircraft, a significant gain could be achieved forward of the aircraft in a plane that includes the horizon. Thus, this antenna provides a broadband way of electronically "seeing" what is ahead of the aircraft.

A conductor-backed coplanar waveguide traveling wave antenna in accordance with the present invention specifically includes a dielectric substrate, a coplanar waveguide structure disposed on the substrate, a plate separated from the substrate for concentrating energy radiated by the antenna (generally in a half-space adjacent to the exterior of the coplanar waveguide structure), and a feed electrically coupled to the coplanar waveguide for transmitting electromagnetic energy to and from the antenna. The aforementioned substrate and plate are separated by a structure which has electromagnetic wave absorbing properties. Preferably, the plate includes a conductive surface facing the substrate. In addition, it is preferred that this structure includes side walls placed perpendicular to the plate and substrate forming an enclosed interior space, and electromagnetic wave absorbing material disposed within the space.

The coplanar waveguide structure includes an electrically conductive layer disposed over a surface of the dielectric substrate. A gap and a strip are formed in the conductive layer which are symmetrical about the longitudinal centerline of the substrate. The gap has its wide end opening into the aft side of a rectangle. The strip is sized such that its width is narrower than the width of the gap at all corresponding points along the longitudinal centerline. The strips wide end terminates into the forward side of the above mentioned rectangle. The strip forms the center conductor of the coplanar wave guide structure and portions of the conductive layer exterior to the gap. The gap, respectively, forms first and second ground planes of the coplanar waveguide structure.

In one version of the present invention, the aforementioned absorbing material extends into the enclosed interior space no closer to the perimeter of the radiating aperture of the antenna than a distance equal to about 0.10λ of a signal being transmitted from or received by the antenna. In another version of the present invention, the electromagnetic wave absorbing material is a homogenous foam completely filling the interior space. It is also noted that the length and width of the antenna are preferably maximized to the extent possible in light of space available in a structure into which the antenna is to be installed, such that the area of the first and second ground planes is maximized. This maximization increases antenna gain near the horizon when the antenna is oriented horizontally.

In one embodiment of the conductor-backed coplanar waveguide traveling wave antenna, the gap and strip are both formed on a same exterior facing surface of the substrate. In this case, the wider end of the center strip contacts the conductive layer of the flared gap at the front side of the rectangle, thus creating an electrically continuous path between the two. The narrow end of the flared gap and the narrow end of the center strip are truncated. A portion of the truncated narrow end of the flared gap separates the terminated, truncated narrow end of the center strip from the first and second ground planes. In addition, a coaxial cable is used as the feed. The center conductor of this cable is connected to the narrow end of the center strip and the outer conductor is connected to the first and second ground planes. The impedance of this antenna can be matched to the cable by including a linearly tapered section on the narrow end of the flared portion of the gap, or on the narrow end of the center strip, or both. The length of this tapered section should be sufficient to closely match the impedance of the coplanar waveguide to that of the feed. Alternately, the width of the center strip can be uniformly varied an amount sufficient to closely match the impedance of the coplanar waveguide to that of the feed.

In another, and more preferred, embodiment of the antenna, the surface of the substrate upon which the gap is formed is an exterior facing surface, and the center strip is disposed on an opposing surface facing the lower conductor disposed on the plate. In addition, this embodiment includes a provision for electrically connecting the wider end of the center strip through the substrate to the gaps conductive layer at the aft side of the rectangle. The center strip of this embodiment includes a tapered section at its narrow end. In addition, the feed in this embodiment is a microstrip feed line connected to the narrow end of the center strip at a point where the width of the aforementioned tapered section approximately equals that of the microstrip feed line. Thus the tapered section is used to smoothly transition the width of the center strip to that of the microstrip feed line. There is also a linearly tapered section included at the narrow end of the flared portion of the gap. The tapered section has a length at least equal to one-quarter of the wavelength of a signal being transmitted on the microstrip feed line from the apex of the tapered section to a point where the tapered section width is the same as the underlying center strip. The second embodiment may be viewed as a flared microstrip slotline in which the slotline forms the radiating aperture.

In either embodiment it is preferred that the flared portion of the gap and the flared center strip be exponentially flared. It is further preferred that the length of the gap and center strip along the longitudinal centerline be at least 0.43λ in length, and that the point of maximum width of the gap along a direction perpendicular to the longitudinal centerline be at least 0.40λ, for transmitted or received signals where λ is the free space wavelength. It is similarly preferred that the distance separating the lower conductor from the substrate be less than about 0.05λ, at the lowest operating frequency defined by maximum VSWR on the order of 2:1.

It can be seen that all the objectives of the invention have been accomplished by the above-described embodiments of the present invention. In addition, other objectives, advantages and benefits of the present invention will become apparent from the detailed description which follows hereinafter when taken in conjunction with the drawing figures which accompany it.

DESCRIPTION OF THE DRAWINGS

These and other features, aspects, and advantages of the present invention will become better understood with regard to the following description, appended claims, and accompanying drawings where:

FIGS. 3A–B are tables providing y(x) values for various exemplary x values derived from equations which define the exponential curves used to construct the preferred flared coplanar waveguide of an antenna according to the present invention. FIG. 3A provides such values for an outer curve, and FIG. 3B provides such values for an inner curve.

FIGS. 4A–C are typical radiation patterns of an antenna according to the present invention wherein FIG. 4A shows the co-pol azimuthal pattern, FIG. 4B shows the co-pol elevation pattern, and FIG. 4C shows the cross-pol azimuthal pattern, as exemplified by the tested embodiment of the antenna of FIG. 1.

FIGS. 6A–B are graphs of time domain bandpass responses wherein FIG. 6A shows the response for the antenna of FIG. 1, and FIG. 6B shows the response of the antenna of FIG. 5A.

FIG. 8 is a table providing radiation pattern and gain values for the tested embodiment of the antenna of FIG. 5A.

DETAILED DESCRIPTION OF THE PREFERRED EMBODIMENTS

Preferred embodiments of the present invention will now be described with reference to the drawings.

Figure 1:
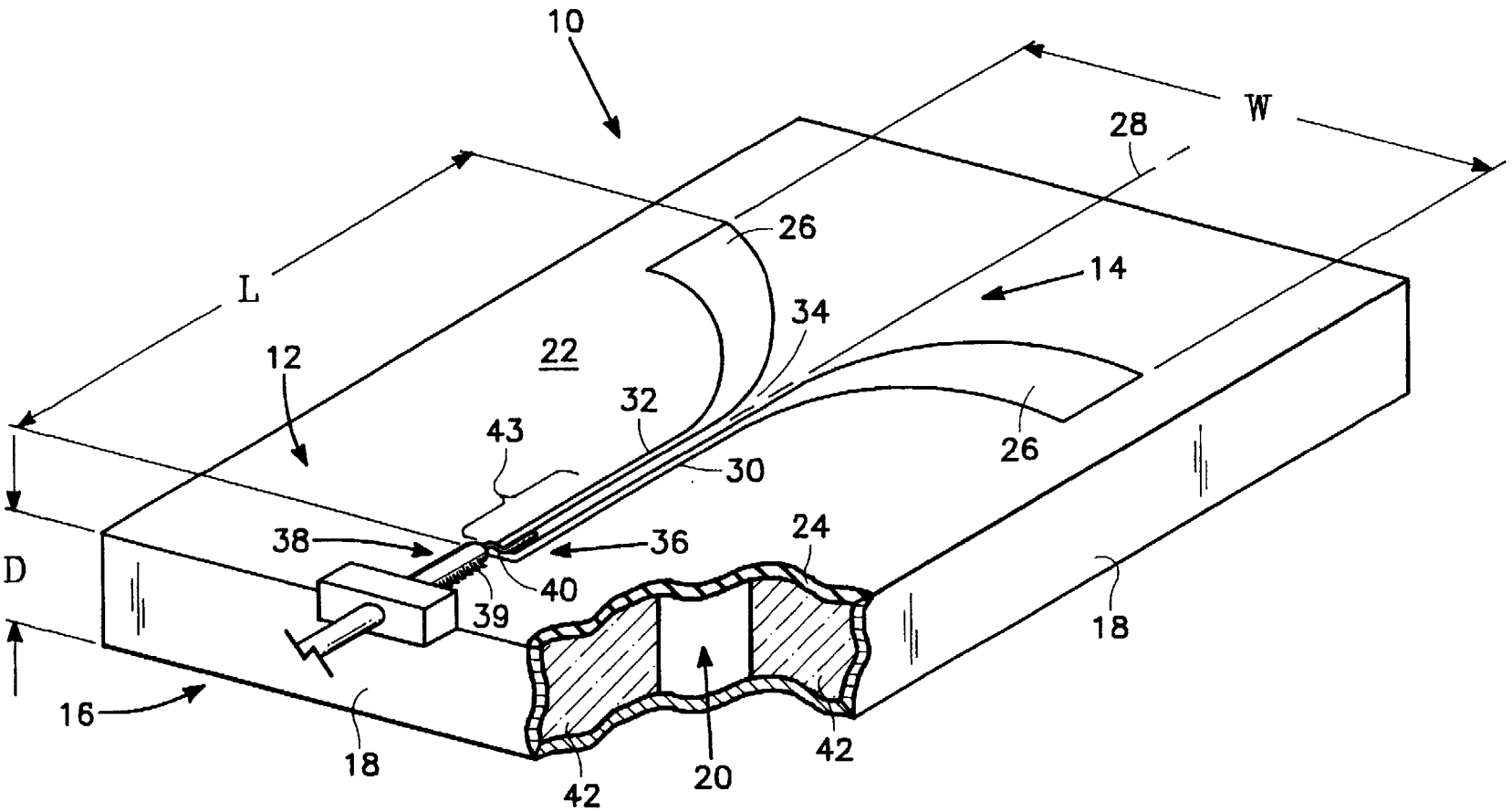
FIG. 1 is a partially cut-away isometric view of a flared conductor-backed coplanar waveguide traveling wave antenna according to the present invention wherein the center strip and ground planes of the coplanar waveguide portion of the antenna are both on the exterior surface of the substrate forming the top of the antenna structure.
Figure 2B:
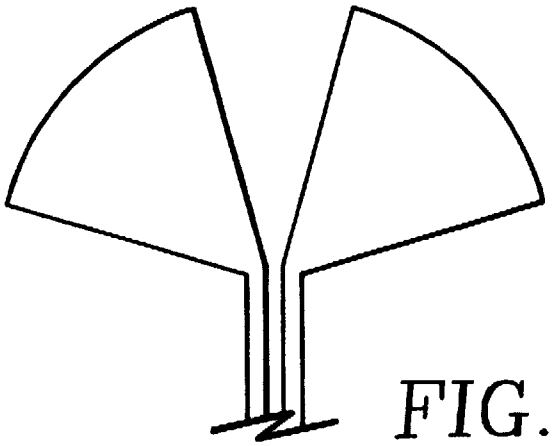
FIGS. 2A–G are diagrams of various alternative flared shapes that the coplanar waveguide portion of an antenna according to the present invention could exhibit.
Figure 2D:
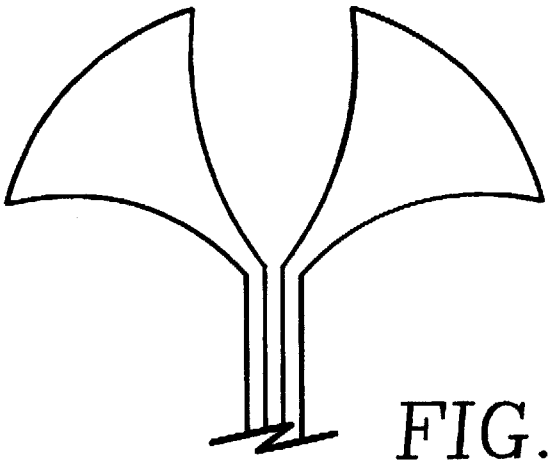
Figure 2A:
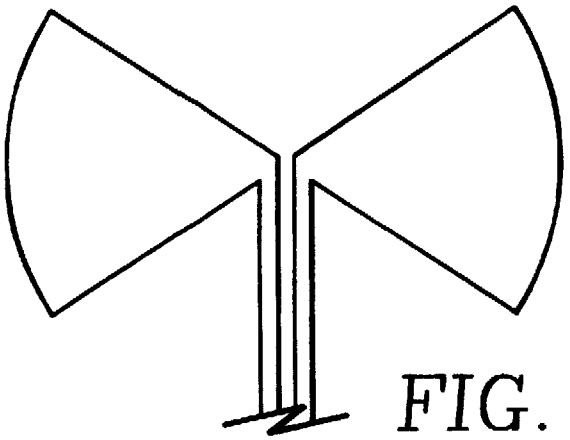
Figure 2C:
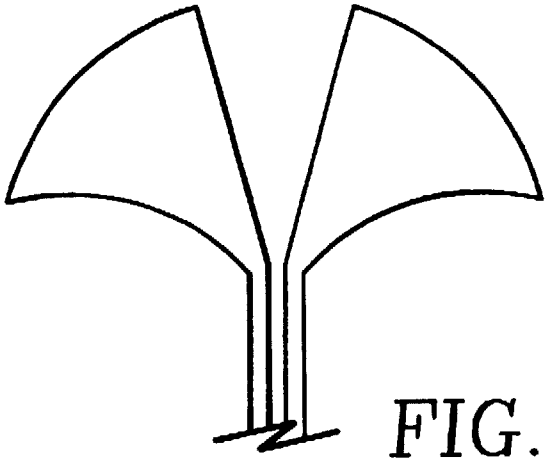
Figure 2E:
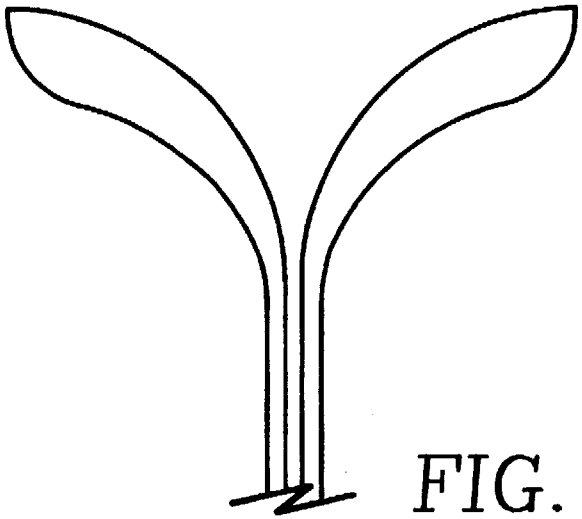
Figure 2F:
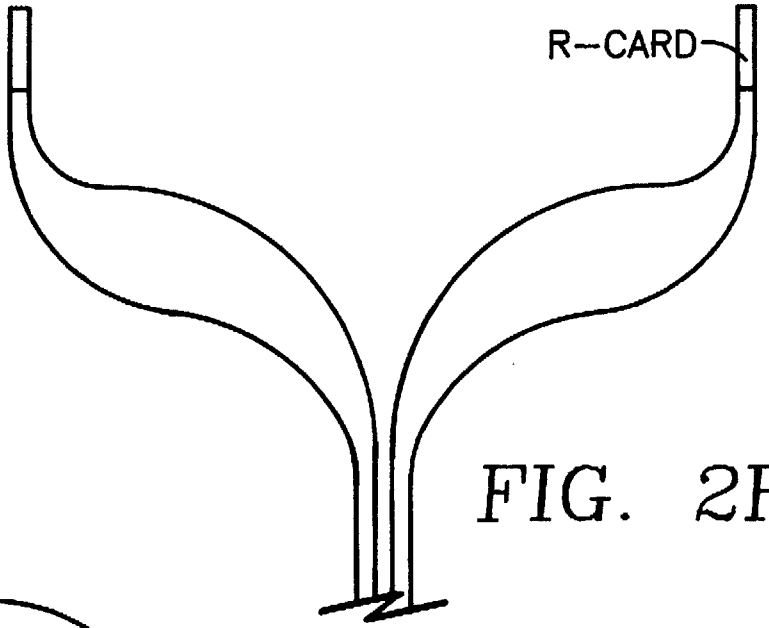
Figure 2G:
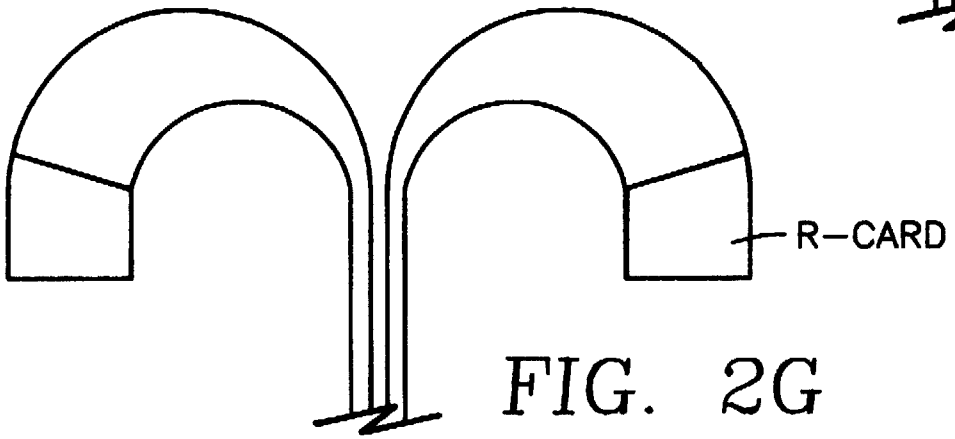

FIG. 1 shows one embodiment of the flush-mountable broadband traveling wave antenna according to the present invention. The overall structure of the antenna is that of a finite length of conductor-backed coplanar waveguide (CBCPW) 10. The top 12 of this structure includes a coplanar waveguide 14 section, and the bottom 16 has a conductive material disposed over its inner surface to form the conductor backing of the CBCPW 10. Vertical sidewalls 18 separate the top and bottom 12, 16, thereby enclosing an internal space 20. This internal space 20, along with the conductor backing of the antenna, are used to support propagation of a received or transmitted signal along the length of the coplanar waveguide 14. Accordingly, this is not a resonant cavity-backed antenna at all. Rather the space 20 simply defines the separation between the aperture of the antenna and its conductor backing. In fact, this structure creates a traveling wave antenna, not a resonant antenna, thus accounting for its broadband capabilities.

The conductor backing disposed on the bottom 16 of the antenna structure also has the advantage of concentrating the radiated power of the antenna in the upper half-space region (assuming the antenna is oriented horizontally with the coplanar waveguide portion 14 facing up). Granted, the same effect could be obtained by employing an electromagnetic energy absorbing material in place of conductive backing. However, typically such absorbing material is more expensive and requires a support structure to ensure its integrity. Absorbing materials also often require an adjacent conductive layer to function properly. Thus, a conductive layer would exist anyway, even though not employed as a method of concentrating the radiant power of the antenna. And finally, if the separation between the coplanar waveguide portion 14 of the antenna and a hypothetical backing of absorber material is less than 0.25λ, the traveling wave produced by the antenna will be attenuated by the absorber material, thereby reducing antenna gain. As will be discussed later, an antenna thickness corresponding to 0.25λ may be too thick for certain applications. The separation between the coplanar waveguide 14 and a conductor backing can be much smaller. Accordingly, although an absorber material backing could be used, a conductor backing is preferred.

The coplanar waveguide 14 is formed in a surface layer 22 made from a conductive material printed on a dielectric substrate 24, such as duroid. Together the surface layer 22 and substrate 24 form the aforementioned top 12 of the antenna structure. Symmetrical notches or gaps 26 in the surface layer 22 on either side of the longitudinal axis 28 of the CBCPW 10, create the waveguide 14 structure, with coplanar ground planes 30, 32 forming the outer boundaries of each gap 26, respectively, and a center strip 34 disposed between the gaps 26 forming their inner boundaries. In a preferred version of the invention illustrated in FIG. 1, the width of the center strip 34 increases exponentially along the longitudinal axis 28. Similarly, the distance between ground planes 30, 32 increases exponentially in the same direction along the longitudinal axis 28. Thus an exponentially flared antenna aperture is created. The above-described aperture preferably has a length of at least 0.43λ in the direction of the longitudinal centerline, and a point of maximum width along a direction perpendicular to the longitudinal centerline of at least 0.40λ, for transmitted or received signals where λ is the free space wavelength. This equates to the physical dimensions "L" (length) and "W" (width) shown in FIG. 1. Even though the exponentially flared aperture depicted in FIG. 1 is preferred, other flared aperture shapes can be substituted if desired. For instance, the gaps 26 could have edges which are linear, circular, or cosine-shaped, among others. The edges could also be a combination of these shapes as well. FIGS. 2A–G show a few possible examples. It is noted that the apertures in FIGS. 2F and 2G terminate in a R-card element to improve the lowest frequency VSWR performance.

Returning to FIG. 1, the aforementioned aperture has an electrically narrow feed end 36. Preferably, the width of the feed end 36 between ground planes 30, 32 is no more than about 0.10λ of the signal being transmitted or received. The electrically narrow feed end 36 of the aperture is fed by a coaxial cable 38. The center conductor 40 of the cable 38 is connected to the center strip 34 and the outer shield 39 is connected to the ground planes 30, 32.

An absorber material 42 is disposed in the interior space 20 formed by the vertical sidewalls 18 to prevent signal reflections from these sidewalls 18, thereby suppressing LSM and LSE mode resonances in the space 20. In essence, the absorber material 42 makes the side walls "invisible" to a wave launched from the interior of the cavity. Thus, propagation is supported along the antenna aperture without interference. In one version of the present invention, it is preferred that the absorber material 42 not be placed any closer than 0.10λ from either of the gaps 26. This prevents attenuation of the wave, thereby maximizing the gain of the antenna. Any standard multilayered AN-type absorber material can be employed with satisfactory results. In addition, the external surfaces of the sidewalls are metalized. This enhances the effectiveness of the absorber material, as is well known. The metalized sidewalls also prevent radiation from the sides of the antenna structure. This type of radiation is undesirable in some applications.

In another version of the present invention, the space 20 is instead filled with a carbon-loaded homogenous foam type absorber material. Since the absorber material fills the space 20, the propagated wave is somewhat attenuated, as compared to the version of the invention with an open space 20. However, it has been found that the lowest frequency at which the antenna could be operated, while still producing a maximum VSWR of about 2:1, was substantially lower than achieved with the non-filled version. Thus, a lower gain is traded for a broader band operation at lower frequencies. This broader lower frequency operating capability has advantages in some applications, even though the gain is lower.

The CBCPW 10 antenna of FIG. 1 is intended for use in flush mounted applications, such as in a horizontal wing structure of an airplane, or other exterior surfaces of aircraft, missiles, drones, automobiles, or even toys. This being the case, it is desirable that the thickness of the antenna be minimized to facilitate mounting it flush with the external surface of the host structure without substantial interference with any internal components adjacent the mounting site. In the aforementioned tested embodiment, it was found that the depth of the space 20 which constitutes most of the thickness of the antenna could be limited to approximately 0.05λ, at the lowest operating frequency defined by maximum VSWR on the order of 2:1, while still obtaining the desired antenna performance characteristics. This dimension is shown as "D" in FIG. 1. However, it is believed that heights of less than 0.05λ, at the lowest operating frequency, may also be practical without significant degradation in antenna performance.

The tested embodiment was constructed such that L≅8.5 inches, W≅8.0 inches and D≅1.0 inches. The exponential curves defining the outer and inner boundaries of the gaps 26 were determined in the following manner. Looking perpendicular to the line of symmetry between the two gaps, and with the feed end 36 position so as to be on the right hand side, the curves defining the outer boundaries of the gaps 26 are based on the equation:

$$y(x)=0.071944\cdot\exp[x]+0.072 \text{ inches} \quad (1)$$

The curve defining the outer boundary of the more distant gap 26 corresponds to the actual positive values of y(x) generated by equation (1), whereas the curve defining the outer boundary of the closer gap 26 corresponds to the negative of these same values. The curves defining the inner boundaries of the gaps 26 are based on the equation:

$$y(x)=0.009791\cdot\exp[x]+0.050 \text{ inches} \quad (2)$$

Here again, the curve defining the inner boundary of the more distant gap 26 corresponds to the actual positive values of y(x) generated by equation (2), whereas the curve defining the inner boundary of the closer gap 26 corresponds to the negative of these same values. The tables of FIGS. 3A–B show some exemplary values of y(x) for specific values of x used in defining the outer and inner curves of the more distant gap 26, respectfully. Values of y(x) for the closer gap would be obtained by taking the negative of the y(x) values presented in FIG. 3. The first value of y(x) in both equation (1) and (2) is derived from an initial value of x=−2.0. In addition, the last value of y(x) in equation (1) is derived from a value of x=4.0, and the last value of y(x) in equation (2) is derived from a value of x=6.0. The result of implementing the above equation is equation is the symmetrical gaps 26 shown in FIG. 1, with two exceptions. First, a linear tapered section 43 can be added to the feed end 36 of the antenna to change the characteristic impedance at the feed end 36 so that it closely matches that of the coaxial cable 38. The tapered section 43 can be created by linearly narrowing the separation between the ground planes 30, 32, or the width of the center strip 34, or both, as long as the center strip 34 does not touch the ground planes 30, 32. In the tested embodiment it was found that a 0.5 inch long tapered section where the separation between ground planes was reduced from 0.164 inches to 0.144 inches, and the width of the center strip was narrowed from 0.102 inches to 0.100 inches, improved the impedance match with the coaxial cable 38. In addition, the feed end of the center strip 34 is truncated slightly short of the point where the gaps 26 merge and are themselves truncated, as shown in FIG. 1. Thus, the center strip 34 is electrically isolated from the ground planes 30, 32 in this area to prevent shorting of the coaxial cable 38. Finally, the overall width of the antenna was 12 inches and its length was 18 inches. This overall size defines the area of the ground planes 30, 32. The aforementioned overall dimensions were chosen as being convenient for testing purposes, and because the resulting area of the ground planes 30, 32 produced an advantageous gain near the horizon (i.e. with the antenna oriented horizontally). It is believed that larger ground plane areas would produce even higher gains at the horizon. Therefore, if the overall dimensions of the antenna are not limited by the structure in which it is to be installed, larger overall dimensions, and so a larger ground plane area, would be preferred.

Figure 4B:
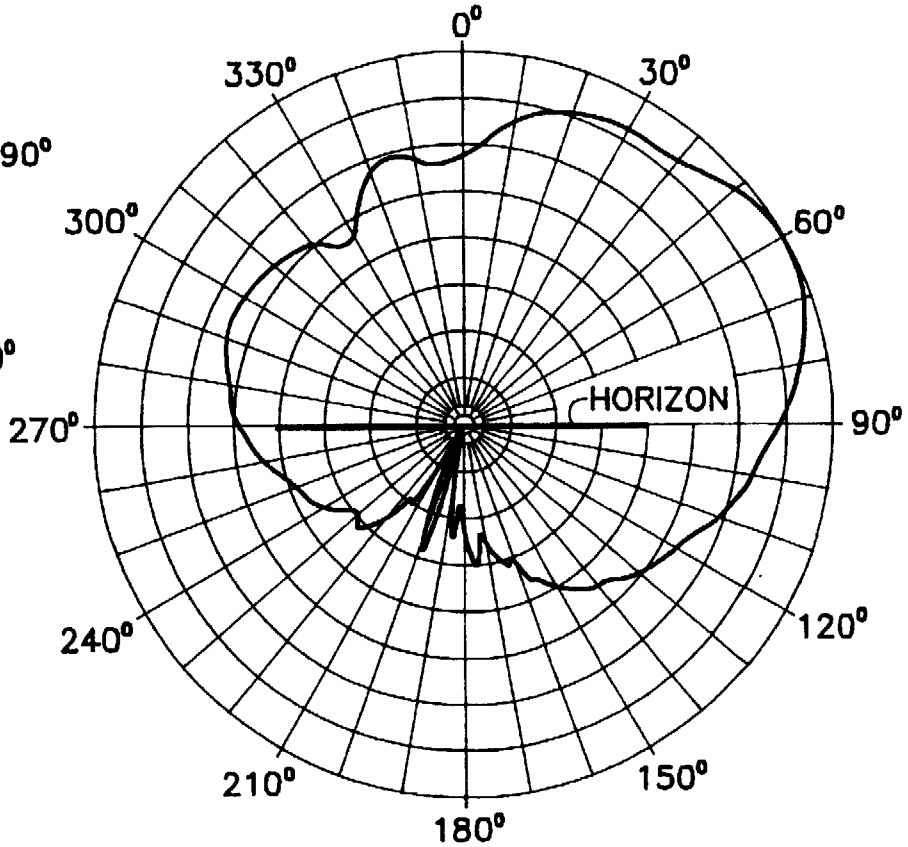
Figure 4A:
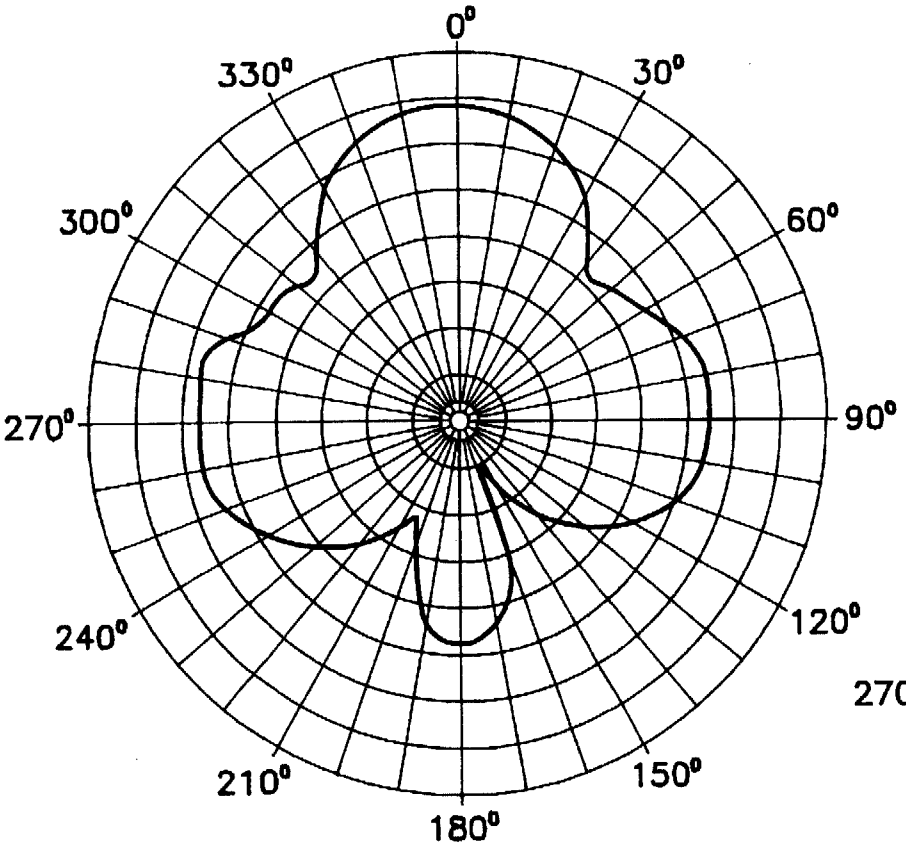
Figure 4C:
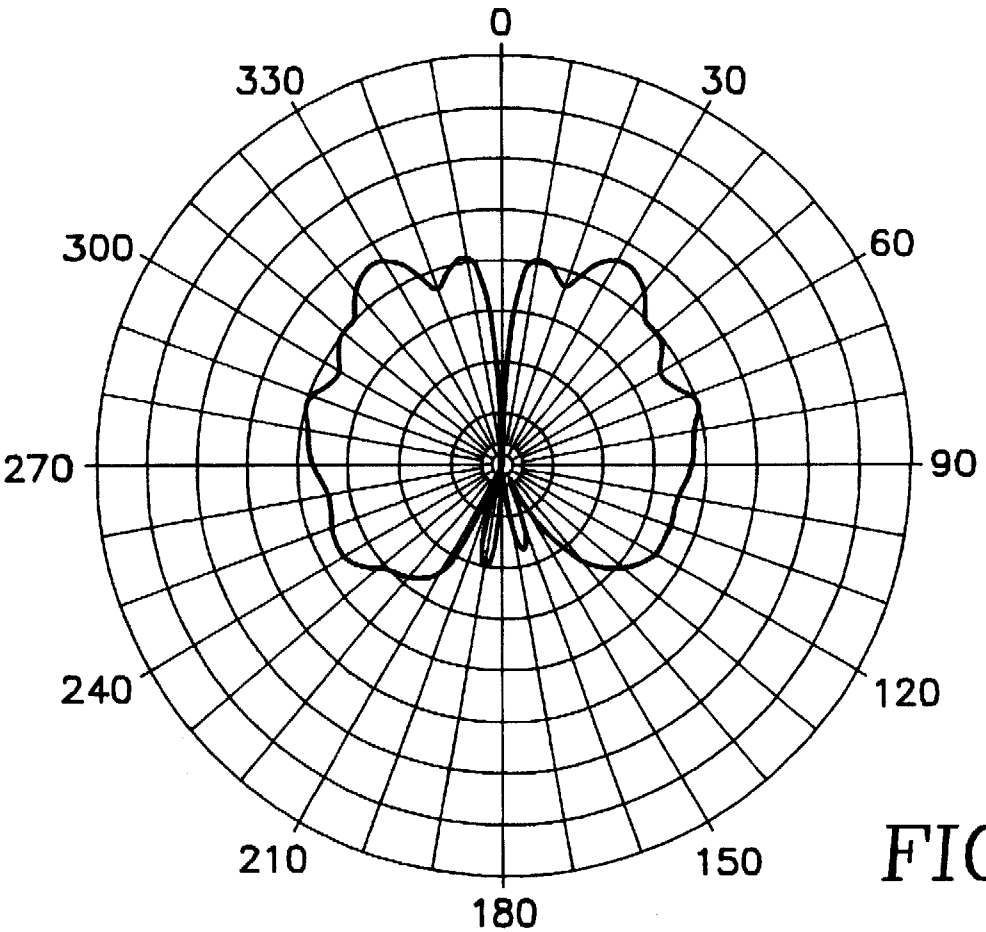

Testing of the above-described embodiment of FIG. 1 was conducted as follows. Measurements of selected antenna characteristics were taken in the L-band (i.e. 1.0–2.0 GHz). Specifically, with the plane of the aperture oriented horizontally, it was found that gain patterns at 1, 1.5, 2, and 2.5 GHz showed an H-plane half power beamwidth of 55 to 45 degrees. In addition, the peak vertically polarized gains were +2.5 to +6.7 dBi throughout the L-band range with gains at the horizontal plane of −2.5 to +1.1 dBi. And finally, the elevation angle of the main beam was found to be 40 to 25 degrees over the aforementioned frequency range. FIGS. 4A–B show the respective V-pol (co-pol) azimuthal and elevation radiation patterns of the tested embodiment at 2.0 GHz, and FIG. 4C shows the H-pol (cross-pol) azimuthal radiation pattern at this same frequency.

As can be seen, the CBCPW 10 antenna of FIG. 1 provides an endfire radiation pattern. The dominant polarization of this antenna is perpendicular to the plane of the aperture. Thus, if the antenna is flush mounted to a horizontal wing surface of an aircraft, a vertically-polarized radiation pattern is produced along the forward field of view that includes the horizon. Such a radiation pattern makes this antenna well suited for aircraft because the gain is concentrated near the horizon forward of the aircraft, allowing electronic surveillance of what is ahead. In addition, it can be seen that a null exists in the H-pol radiation pattern in the plane of symmetry of the antenna aperture. This has advantages where discrimination between the co-pol and cross-pol radiation is important. For instance, a transducer strategically placed in the plane of symmetry of the antenna in accordance with the present invention would detect only co-pol radiation.

Another major advantage of the CBCPW 10 antenna of FIG. 1 is that it exhibits an inherent unbalanced feed structure which is easily coupled with broadband performance to other unbalanced structures, such as a microstrip or coaxial cable. The lack of a need for a balun simplifies the construction of the antenna and provides low VSWR over the microwave spectrum. In addition, a coplanar waveguide has a dominant mode exhibiting a phase velocity which is relatively constant with frequency, as compared to a slotline used in conventional notch antennas. Typically, the phase velocity does not vary more than a few percent from DC to 10 GHz. This practically constant phase velocity acts to minimize changes in the impedance of the antenna. Thus, impedance matching problems between the antenna and the feed line are considerably lessened, even though the antenna is operated over a multioctave bandwidth.

The CBCPW 10 structure of the antenna also provides an advantage in initially matching the impedance between the antenna and the feed line. One method of doing this was discussed in connection with the linear tapered section 43. Alternately, the width of the center strip 34 can be uniformly varied as a design parameter to match the impedance. The outer curves would remain the same, thereby maintaining the overall dimensions of the aperture which substantially defines the beamwidth performance described previously.

Figure 5A:
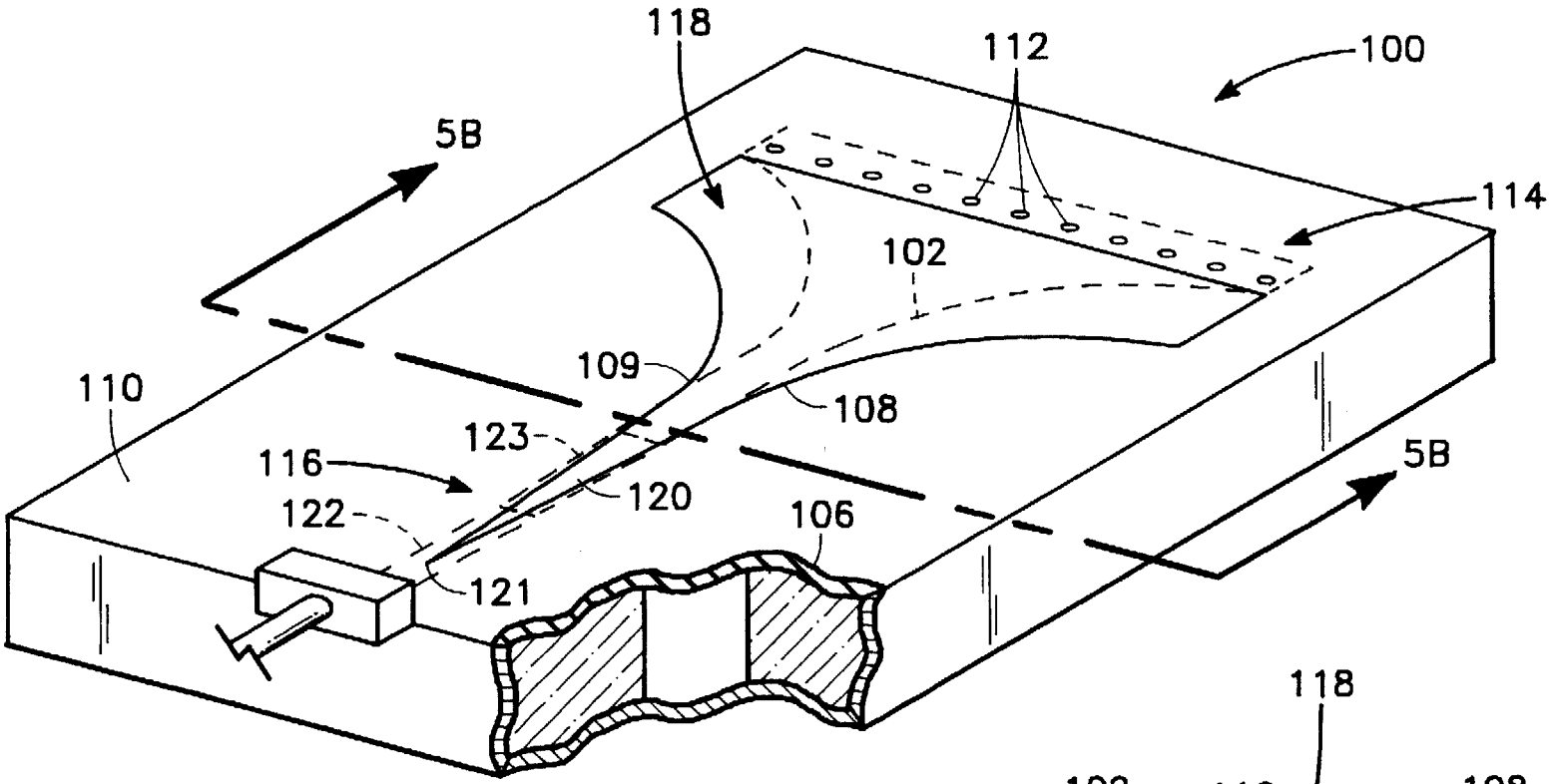
FIG. 5A is an isometric view of a flared conductor-backed coplanar waveguide traveling wave antenna according to the present invention wherein the ground planes of the coplanar waveguide portion of the antenna are on the exterior surface of the substrate forming the top of the antenna structure, and the center strip is disposed on the opposing surface of the top.
Figure 5B:
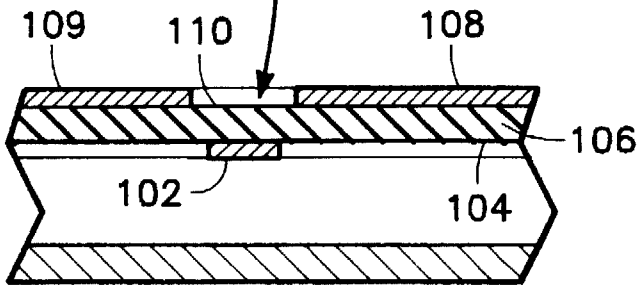
FIG. 5B is a cross-sectional view of the antenna of FIG. 5A taken in the 5B—5B plane.

FIGS. 5A–B show another and more preferred embodiment of the antenna according to the present invention. This embodiment exhibits all the advantages of the embodiment of FIG. 1, including similar radiation patterns and gain levels. However, the physical structure of this second embodiment facilitates impedance matching between the antenna and the feed line, and produces an even lower reflection coefficient at the transition between the two.

This second embodiment of a CBCPW antenna 100 has essentially the same aperture size limitations and structural elements as the antenna of FIG. 1. However, in the second embodiment, the top of the antenna structure has been modified. The center strip 102 is printed on the backside 104 of a thin dielectric layer 106 (i.e. about 10 mils thick) which forms the top of the CBCPW 100. The ground planes 108, 109 are printed on the exterior surface 110 of the dielectric layer 106. Shorting pins 112, or vias, connect the metal layer making up the center strip 102 to that of the ground planes 108, 109 at the low frequency end 114 of the antenna 100, opposite the feed end 116. A microstrip feed line 122, as opposed to the coaxial cable of the previous embodiment, is connected to the center strip 102 at the feed end 116 of the antenna 100. Preferably, the width of the microstrip feed line 122 is the same as the width of the center strip 102 at their point of connection. This provides a smooth transition from the feed line 1 22 to the center strip 102.

The same exponential curves discussed above in connection with the first embodiment are used to define the boundaries of the ground planes 108, 109 and the center strip 102 in this second embodiment of the present invention. In this case, equation (1) is used to define boundaries of the ground planes 108, with positive values of y(x) defining the far side and negative values of y(x) defining the near side, as shown in FIG. 5A. Thus, a single exponentially flared gap 1 18 is formed in the front surface 110 (although, the coplanar waveguide structure of the first embodiment could be thought of as a single gap with the center strip disposed therein, instead of two separate gaps). The gap 118 is not truncated on the feed end 116 of the antenna (i.e. the high frequency side), similar to the first embodiment. Instead, a tapered notch 120 is appended which terminates in an apex 121. This tapered notch 120 forces a bifurcation of the microstrip mode longitudinal electric current which flows on its ground plane. The tapered notch 120 must be, at a minimum, approximately one-quarter of the microstrip guide wavelength from its tip to the point where its cross-sectional width is the same as the underlying center strip 102. Equation (2) is similarly used to define the boundaries of the center strip 102, with positive values of y(x) defining the far side and negative values of y(x) defining the near side. A tapered section 123 is appended to the narrow end of the center strip 102, as necessary, to gradually narrow the center strip 102 to the width of the microstrip line 122. Preferably, this tapered section 123 spans the length of the aforementioned tapered notch 120. Since the same exponential curve equations are employed, the antenna aperture formed in the second embodiment is substantially the same as the first embodiment. This is the primary reason the radiation patterns and gain levels are consistent between the two embodiments.

In a tested embodiment of the antenna of FIG. 5A–B, the gap 118 is 8.0 inches wide and 8.0 inches long excluding the tapered notch 120. A 1.0 inch long tapered notch 120 was employed. Thus, the width of the gap 118 at the beginning of the tapered notch 120 was 0.164 inches, tapering down to the apex 121 over the aforementioned 1.0 inch length of the notch 120. A 0.029 inch wide microstrip line 122 was employed. Therefore, the tapered section 123, appended to the narrow end of the center strip 102, tapers from a width of 0.102 inches at the end of the center strip 102 to a width of 0.029 inches corresponding to that of the microstrip line 122, over the 1.0 inch span of the tapered notch 1 20.

Figure 6A:
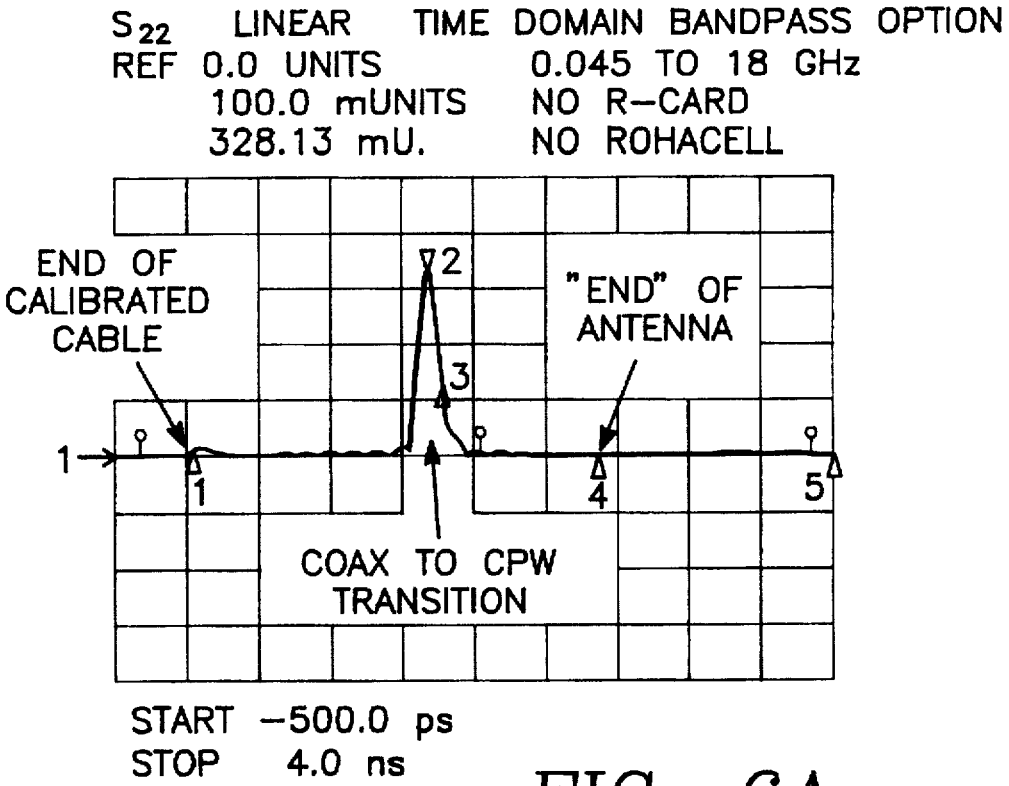
Figure 6B:
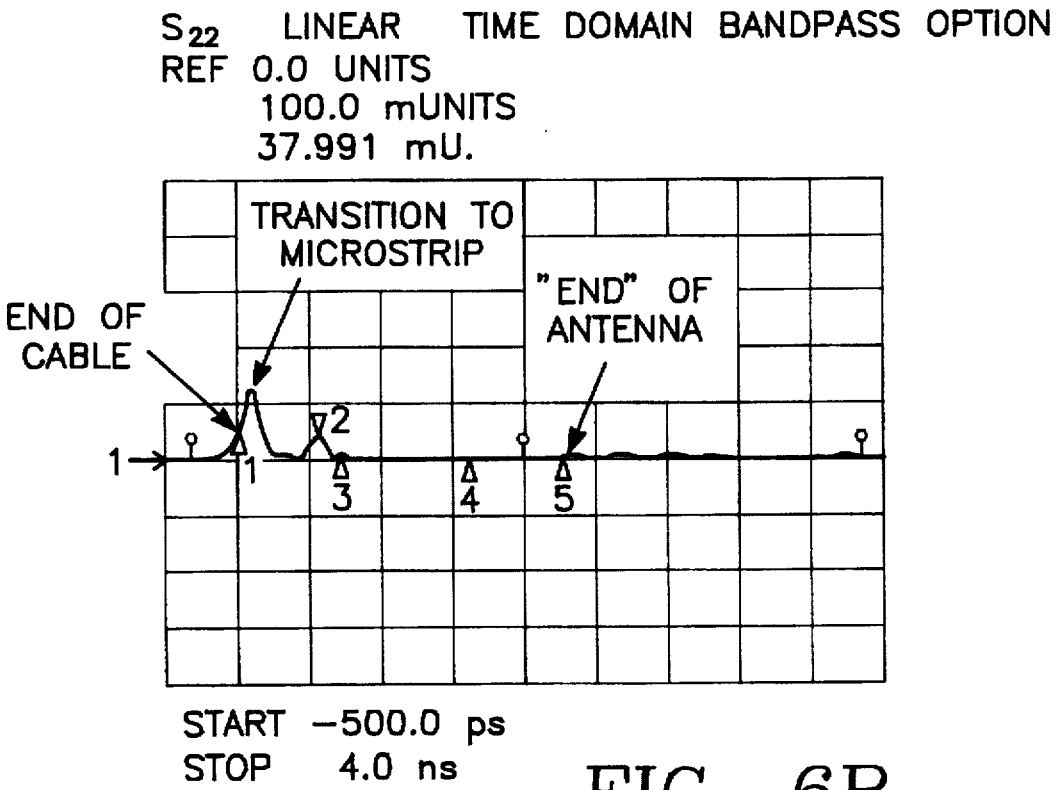

The aforementioned graceful transition between the microstrip feed line 122 and the center strip 102 on the backside 104 of the dielectric layer 106, and the use of the tapered notch 120, provides for a lower reflection coefficient than was possible with the coaxial connection of the first-described embodiment of the present invention. The graph shown in FIG. 6A shows the time domain bandpass responses for the first-described embodiment, whereas the graph in FIG. 6B shows these responses for the second embodiment. As can be seen, a reduction of the reflection coefficient from 0.328 to 0.038 was observed for voltage waves reflected at the transition between the respective feed lines and center strips at the high frequency end of the aperture. Thus, improved VSWR performance is obtained with the above-described second embodiment of the present invention.

In addition to the reduced refection coefficient, the second embodiment also has the advantage of electromagnetically shielding the microstrip feed line 122. This results in limiting the radiation and scatter from discontinuities in the microstrip 122, or from additional circuitry that may be located near the antenna 100.

Figure 7:
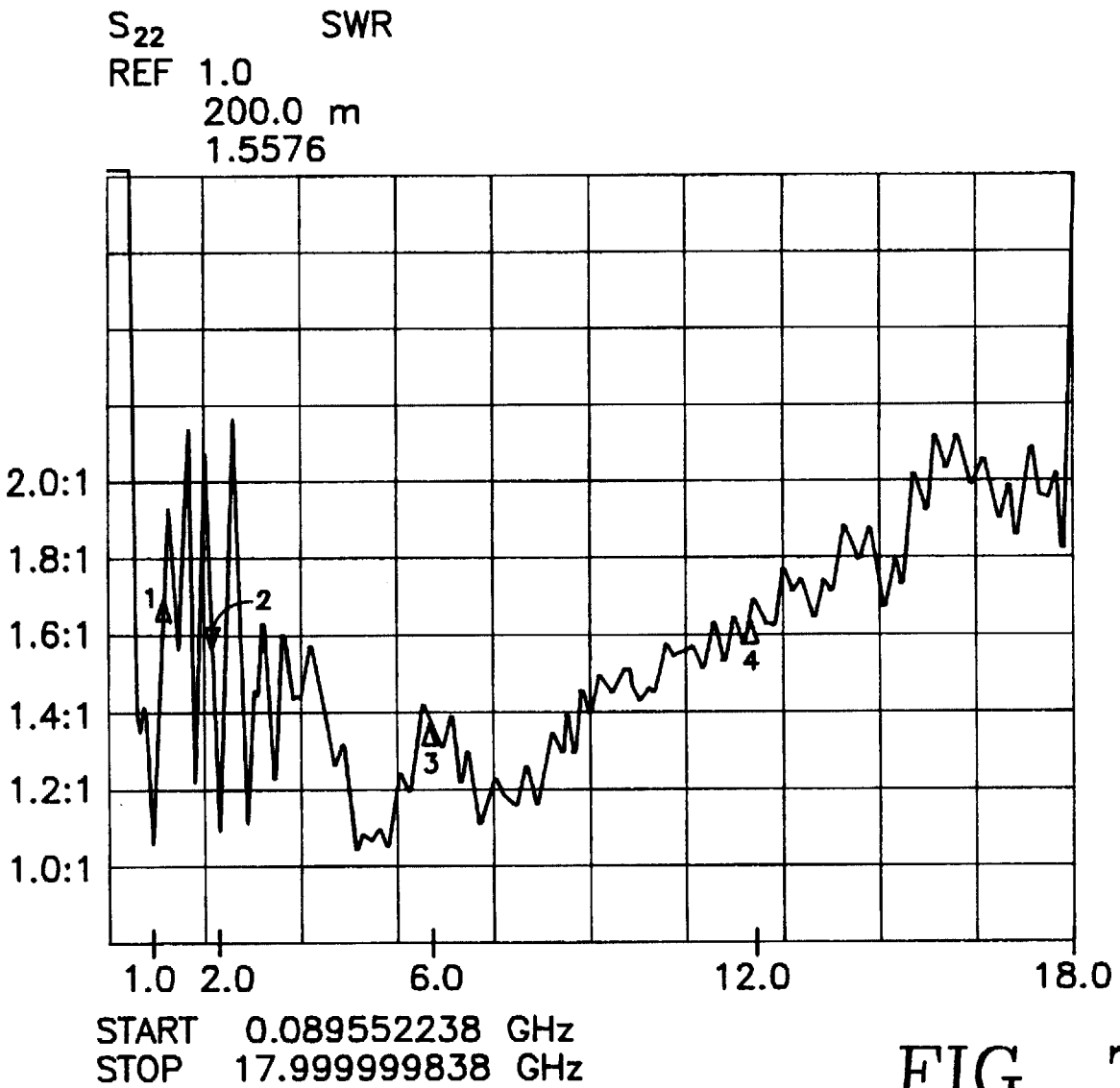
FIG. 7 is a graph showing the VSWR plot of a tested embodiment of the antenna of FIG. 5A.

Testing of the second embodiment resulted in the VSWR plot of FIG. 7. A VSWR of lower than 2.2:1 is achieved from 575 MHz to 17.9 GHz, a frequency ratio exceeding 30:1. Radiation patterns and gain were measured over L, S and C frequency bands. Results are shown in the table of FIG. 8. An alternate version of the second embodiment where the space 20 was filled with the previously described carbon-loaded homogeneous foam type absorber material was also tested. It was found that at 1 GHz, the peak antenna gain was reduced from 1.8 dBi to −12.0 dBi. However, the lowest operating frequency still exhibiting a maximum VSWR of about 2:1 was 185 MHz, rather than the aforementioned 575 MHz.

While the invention has been described in detail by reference to the preferred embodiments described above, it is understood that variations and modifications thereof may be made without departing from the true spirit and scope of the invention.

Wherefore, what is claimed is:

1. A coplanar waveguide traveling wave antenna for receiving and transmitting electromagnetic waves comprising:

(a) a dielectric substrate;

(b) a coplanar waveguide structure disposed on the substrate;

(c) a plate for concentrating a substantial portion of the energy radiated by the antenna in a half-space adjacent the exterior of the coplanar waveguide structure, said plate being separated from the substrate and the coplanar waveguide structure and substantially parallel thereto; and, (d) a feed electrically coupled to the coplanar waveguide structure for transmitting electromagnetic energy to and from the antenna.

2. The coplanar waveguide traveling wave antenna according to claim 1, wherein the plate comprises:

a conductive surface facing the substrate.

3. The coplanar waveguide traveling wave antenna according to claim 1, further comprising:

a means for separating the plate from the substrate, said separating means having electromagnetic wave absorbing properties.

4. The coplanar waveguide traveling wave antenna according to claim 3, wherein the said separating means comprises:

(a) side walls placed perpendicular to the plate and substrate forming an enclosed interior space; and, (b) electromagnetic wave absorbing material disposed adjacent to an interior side of said side walls, said absorbing material extending into the enclosed interior space no closer to the perimeter of a gap of the coplanar waveguide than a distance equal to about 0.10λ of a signal being one of (i) transmitted from or (ii) received by the antenna.

5. The coplanar waveguide traveling wave antenna according to claim 3, wherein the said separating means comprises:

(a) side walls placed perpendicular to the plate and substrate forming an enclosed interior space; and, (b) electromagnetic wave absorbing foam filling said interior space.

6. The coplanar waveguide traveling wave antenna according to claim 1, wherein the coplanar waveguide structure comprises:

(a) an adherent electrically conductive layer disposed over a surface of the dielectric substrate, said electrically conductive layer having a gap formed therein, said gap being symmetrical about a longitudinal centerline of the substrate and having a flared portion the wider end of which opens into a box end portion; and, (b) an adherent electrically conductive flared strip disposed over a surface of the substrate, said strip being symmetrical about the longitudinal centerline and sized such that the width thereof is narrower than the width of the gap at all corresponding points along the longitudinal centerline, said strip also terminating on wider end thereof at a location on the substrate corresponding to a back end of the box end portion of the gap; wherein, (c) the strip forms a center strip of a the coplanar waveguide structure and portions of the conductive layer exterior to the gap respectively form first and second ground planes of the coplanar waveguide structure.

7. The coplanar waveguide traveling wave antenna according to claim 6, wherein:

(a) the gap and strip are both formed on a same exterior facing surface of the substrate; and, (b) the narrow end of the flared portion of the gap and the narrow end of the center strip are truncated and a portion of the truncated narrow end of the flared portion of the gap separates the termination of the truncated narrow end of the center strip from the first and second ground planes.

8. The coplanar waveguide traveling wave antenna according to claim 7, wherein the feed comprises:

(a) a coaxial cable having a center conductor connected to the narrow end of the center strip and an outer conductor connected to the first and second ground planes.

9. The coplanar waveguide traveling wave antenna according to claim 7, wherein:

at least one of (i) the narrow end of the flared portion of the gap, and (ii) the narrow end of the center strip comprises a linearly tapered section of a length sufficient to closely match the impedance of the coplanar waveguide to that of the feed.

10. The coplanar waveguide traveling wave antenna according to claim 7, wherein:

the width of the center strip is uniformly varied an amount sufficient to closely match the impedance of the coplanar waveguide to that of the feed.

11. The coplanar waveguide traveling wave antenna according to claim 6, wherein:

a length and width of the antenna are maximized to the extent possible in light of space available in a structure into which the antenna is to be installed, such that the area of the first and second ground planes is maximized.

12. The coplanar waveguide traveling wave antenna according to claim 6, wherein:

(a) the surface upon which the gap is formed is an exterior facing surface and the center strip is disposed on an opposing surface facing the conductive surface of the plate; and wherein the antenna further comprises, (b) means for electrically connecting the wider end of the center strip to the conductive layer adjacent the back end of the box end portion of the gap through the substrate.

13. The coplanar waveguide traveling wave antenna according to claim 12, wherein:

(a) the narrow end of the center strip includes a tapered section; and, (b) the feed comprises a microstrip feed line connected to the narrow end of the center strip at a point where the width of the tapered section of the center strip approximately equals that of the microstrip feed line.

14. The coplanar waveguide traveling wave antenna according to claim 12, wherein:

the narrow end of the flared portion of the gap comprises a linearly tapered section having a length at least equal to one-quarter of the wavelength of a signal being transmitted on the microstrip feed line from an apex of the tapered section to a point where the tapered section width is the same as the underlying center strip.

15. The coplanar waveguide traveling wave antenna according to claim 6, wherein:

the flared portion of the gap and the flared center strip are exponentially flared.

16. The coplanar waveguide traveling wave antenna according to claim 6, wherein:

(a) the length of the gap and center strip along the longitudinal centerline is at least about $0.43\lambda$ of a signal being one of (i) transmitted from or (ii) received by the antenna; and, (b) the maximum width of the gap and center strip perpendicular to the longitudinal centerline is at least about $0.40\lambda$ of said signal.

17. The coplanar waveguide traveling wave antenna according to claim 1, wherein:

the distance separating the plate from the substrate does not exceed about $0.05\lambda$ of a signal being one of (i) transmitted from or (ii) received by the antenna, and corresponding to a lowest frequency of operation of the antenna.

18. A broadband traveling wave antenna structure for receiving and transmitting electromagnetic waves comprising:

(a ) a dielectric substrate;

(b) a coplanar waveguide structure disposed on the substrate; and, (c) a plate separated from the substrate and the coplanar waveguide structure and substantially parallel thereto, and having a conductive surface facing the substrate, said plate further concentrating a substantial portion of the energy radiated by the antenna in a half-space adjacent the exterior of the coplanar waveguide structure.

19. The broadband traveling wave antenna structure according to claim 18, further comprising:

a means for separating the plate from the substrate, said separating means having electromagnetic wave absorbing properties.

20. The broadband traveling wave antenna structure according to claim 18, wherein the coplanar waveguide structure comprises:

(a) an adherent electrically conductive layer disposed over a surface of the dielectric substrate, said electrically conductive layer having a gap formed therein, said gap being symmetrical about a longitudinal centerline of the substrate and having a flared portion the wider end of which opens into a box end portion; and, (b) an adherent electrically conductive flared strip disposed over a surface of the substrate, said strip being symmetrical about the longitudinal centerline and sized such that the width thereof is narrower than the width of the gap at all corresponding points along the longitudinal centerline, said strip also terminating on wider end thereof at a location on the substrate corresponding to a back end of the box end portion of the gap; wherein, (c) the strip forms a center strip of a the coplanar waveguide structure and portions of the conductive layer exterior to the gap respectively form first and second ground planes of the coplanar waveguide structure.

21. The broadband traveling wave antenna structure according to claim 20, wherein:

(a) the gap and strip are both formed on a same exterior facing surface of the substrate; and, (b) the narrow end of the flared portion of the gap and the narrow end of the center strip are truncated and a portion of the truncated narrow end of the flared portion of the gap separates the termination of the truncated narrow end of the center strip from the first and second ground planes.

22. The broadband traveling wave antenna structure according to claim 20, wherein:

(a) the surface upon which the gap is formed is an exterior facing surface and the center strip is disposed on an opposing surface facing the conductive surface of the plate; and wherein the antenna further comprises, (b) means for electrically connecting the wider end of the center strip to the conductive layer adjacent the back end of the box end portion of the gap through the substrate.

23. The broadband traveling wave antenna structure according to claim 20, wherein:

a length and width of the antenna are maximized to the extent possible in light of space available in a structure into which the antenna is to be installed, such that the area of the first and second ground planes is maximized.

* * * * *